United States Patent [19]

Levesque

[11] 4,393,974

[45] Jul. 19, 1983

[54] WATERPROOF PLASTIC CONTAINER

[76] Inventor: Michel Levesque, 2091 Montee de la Station, St. Justine de Newton, Canada, J0P 1T0

[21] Appl. No.: 284,081

[22] Filed: Jul. 13, 1981

[51] Int. Cl.[3] ..... A45C 11/00; B65D 6/02; B65D 8/04

[52] U.S. Cl. ..... 206/37; 220/4 B

[58] Field of Search ..... 206/37, 537, 534; 220/4 B

[56] References Cited

U.S. PATENT DOCUMENTS 2,707,552 5/1955 Matthiesen ..... 206/537

2,759,598 8/1956 Tregilgas ..... 206/537

2,965,222 12/1960 Kidwell ..... 206/534

4,333,562 6/1982 Todd ..... 206/534

*Primary Examiner*—William T. Dixson, Jr.

[57] ABSTRACT

A utility capsule that is characterized by its simple and watertight construction and a smooth outer surface to be harmlessly concealed in one's anus for transportation of small things such as could be used by secret agents, swimmers or any other person. This utility capsule comprises opposite closed end sections and intermediate tubular sections of different lengths but always with the same outside diameter to be readily and variably adjustable in length while always retaining the same smooth outside surface.

3 Claims, 4 Drawing Figures

WATERPROOF PLASTIC CONTAINER

FIELD OF THE INVENTION

This invention relates to a small container of the type forming a utility capsule and made of selectively usable sections for adjustment in length.

DESCRIPTION OF THE PRIOR ART

A small utility capsule or container of the above type is disclosed in the U.S. Pat. No. 2,759,598 dated Aug. 21, 1956. The capsule defined in the patent is rather complex to accomodate the closing sleeves for the lateral aperture. There results relatively expensive and relatively non-watertight construction due to the closing sleeves.

SUMMARY OF THE INVENTION

It is a general object of the present invention to provide a utility capsule of the above type that is of simple construction and watertight.

It is another object of the present invention to provide a utility capsule of the above type that is constructed and arranged with an essentially smooth outer surface to be concealed in one's anus and thus unconspecuously transport something such as could be used by secret agents, a swimmer or any other person.

It is a more specific object of the present invention to provide a utility capsule of the above type that is made with opposite closed end sections and intermediate tubular sections of different lengths but always with the same outside diameter to be readily and variably adjustable in length while always retaining the same smooth outside surface.

The above and other objects and advantages of the present invention will be better understood with reference to the following detailed description of a preferred embodiment thereof which is illustrated, by way of example, in the accompanying drawing; in which.

Figure 1:
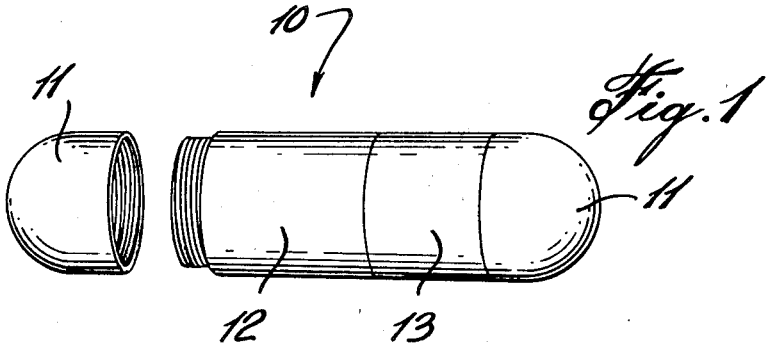
FIG. 1 is a perspective view of a watertight utility capsule according to the present invention and shown with one end section unscrewed.

The illustrated watertight utility capsule 10 comprises a pair of tubular end sections 11 and two tubular intermediate extension sections 12 and 13 of different lengths. Obviously, a larger number of tubular extension sections such as 12, 13 may be provided; preferably also all of different lengths. Each of the tubular end sections 11 is closed at one end and open at the other. The closed end of the tubular end section 11 is outwardly rounded. The intermediate extension sections 12, 13 are open-ended.

The open end of one end section 11 and one end of each intermediate extension section 12, 13 is internally screw threaded. The open end of the other end section 11 and the other end of each intermediate extension section 12, 13 is externally screw threaded to complementarily engage the internally screw threaded end of another section and thus assemble the sections tightly end to end.

Figure 2:
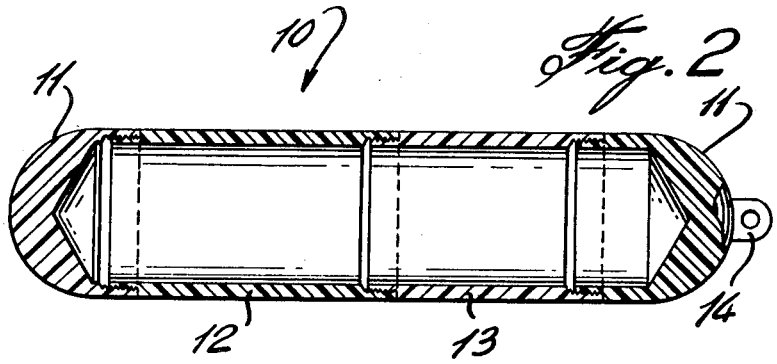
FIG. 2 is a longitudinal cross section through the watertight utility capsule of FIG. 1, with both end sections screwed in position.
Figure 3:
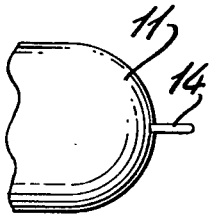
FIG. 3 is a partial view of one end section of the section.

As shown in FIGS. 2 and 3, any rounded end section may be provided with a lug 14 to attach the capsule to a chain or set of key.

Figure 4:
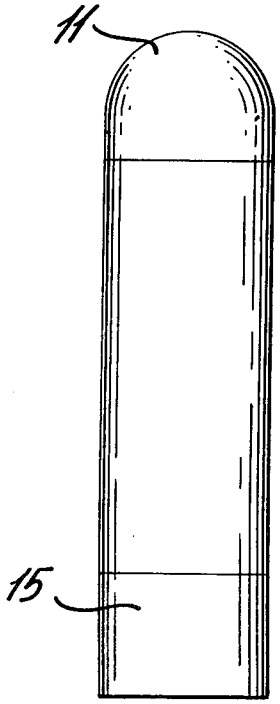
FIG. 4 is a lateral view of a watertight utility capsule according to a variant to stand upright on one end.

As shown in FIG. 4, the capsule may include at least one end section 15 formed with a squared end rather than a rounded outer end.

The sections 11, 12, 13, 15 are of constant cross section and cooperatively form a capsule with a smooth outer surface. The sections are molded of high density polyethylene. The constant cross section is of predetermined size arranged to fit in one user's anus be so concealed.

The intermediate tubular extension sections of different lengths may be used selectively and separately intermediate the tubular opposite end sections and thus form a capsule selectively varying in length from a shortest length merely including only the two opposite end sections, an intermediate length also including at least one of the intermediate extension sections, and a longest length including all the intermediate extension sections intermediate opposite end sections 11,11 or 11,15.

What I claim is:

1. A watertight utility capsule comprising a pair of tubular opposite end sections each including a closed end and an open screw threaded end, said closed end defining a rounded outer surface, at least one intermediate tubular extension section open at both ends, selectively engageable end to end one with another and with the tubular opposite end sections and cooperatively forming therewith a tubular fully closed container, one end of each intermediate section and the open end of one opposite end section being internally screw threaded, the other end of each intermediate section and open end of the other opposite end section being externally screw threaded complementarily relative to the internally screw threading of said one end and the open end of said one opposite end section, and said tubular sections assembling end to end by screwing the externally screw threaded ends into the internally screw threaded ends respectively, said tubular sections having a constant cross-section and, when assembled, defining a completely smooth external surface, with flush joints at each pair of assembled tubular sections, the constant transverse section of said tubular section being of predetermined size arranged to fit in one user's anus to concealably carry something dry in the user's anus.

2. A watertight utility capsule as defined in claim 1, comprising a plurality of intermediate tubular extension sections of different lengths selectively and separately usable intermediate the tubular opposite end sections and thereby forming a capsule selectively varying in length from a shortest length merely including only the two opposite end sections, an intermediate length also including at least one of the intermediate extension sections and a longest length including all the intermediate extension sections intermediate the opposite end sections.

3. A watertight utility capsule as defined in claim 2, wherein said sections are molded of high density polypropylene.

* * * * *